US008246389B2

(12) United States Patent
Zhang et al.

(10) Patent No.: US 8,246,389 B2
(45) Date of Patent: Aug. 21, 2012

(54) ELECTRICAL CONNECTOR HAVING IMPROVED CROSSTALK COMPENSATING PADDLE BOARD

(75) Inventors: Jie Zhang, Kunshan (CN); Bing Wang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/152,340

(22) Filed: Jun. 3, 2011

(65) Prior Publication Data

US 2011/0300758 A1 Dec. 8, 2011

(51) Int. Cl.
*H01R 24/00* (2011.01)

(52) U.S. Cl. ..... 439/676; 439/76.1; 439/941

(58) Field of Classification Search ..... 439/79, 439/76.1, 78, 83, 676, 607.26, 941
See application file for complete search history.

(56) References Cited

U.S. PATENT DOCUMENTS 5,791,943 A 8/1998 Siemon
5,797,943 A * 8/1998 Danks et al. ..... 606/185
6,413,121 B1 7/2002 Hyland
6,447,341 B1 9/2002 Hyland
6,488,544 B1 12/2002 Hyland
6,506,080 B2 1/2003 Hyland
6,612,876 B2 9/2003 Hyland
6,612,877 B2 9/2003 Hyland
6,863,575 B2 3/2005 Hyland
7,967,645 B2 * 6/2011 Marti et al. ..... 439/676

* cited by examiner

*Primary Examiner* — Khiem Nguyen
(74) *Attorney, Agent, or Firm* — Ming Chieh Chang; Wei Te Chung; Andrew C. Cheng

(57) ABSTRACT

An electrical connector (100) includes a paddle board including a first through third faces (310, 311, 312), a number of conductive pads (341-344, 351-356) formed in the second and third faces, a number of conductive sections (321-328), and a number of conductive members (331-338). A selected first conductive section (321) is electrically connected with a selected first conductive member (331) via a first conductive pad (351). A selected second conductive section (322) is electrically connected with a selected second conductive member (332) via a selected second conductive pad (352). A selected third conductive section (323) is electrically connected with a selected third conductive member (333) via a selected third conductive pad. The selected third conductive pad is coupled with the selected first conductive pad.

19 Claims, 10 Drawing Sheets

ELECTRICAL CONNECTOR HAVING IMPROVED CROSSTALK COMPENSATING PADDLE BOARD

BACKGROUND OF THE INVENTION

1. Field of the Invention

The present invention relates to an electrical connector, and particularly, to a modular jack having a paddle board capable of providing compensation between the terminals for reducing crosstalk between the terminals.

2. Description of Related Art

To comply with a high speed trend of data transmission, electrical devices are required to have better performance. Performance requirements have significantly increased to a level identified by industry standards as Category 5. The Telecommunications Industry Association (TIA) in cooperation with the Electronic Industries Alliance (EIA) has developed a proposed standard for Category 5 components. In such high speed applications, electrical coupling between adjacent terminals would be problematic. The electrical coupling between the terminals need be controlled effectively to an acceptable level.

U.S. Pat. No. 7,384,315 issued to Caveney et al. on Jun. 10, 2008 and U.S. Pat. No. 7,914,345 issued to Bopp et al. on Mar. 29, 2011 each disclose a modular connector comprising a housing, a terminal insert received in the housing and a converting module having a plurality of converting terminals. The terminal insert includes a paddle board and a plurality of contact terminals. The paddle board includes a first face, a third face, a second face within the paddle board, a plurality of first conductive holes extending through the first through third faces for insertion of the contact terminals, a plurality of second conductive holes extending through the first through third faces for insertion of the converting terminals, and a plurality of conductive pads formed in the second face for electrically connecting with corresponding first and second conductive holes.

Different known cross-talk compensation schemes are seen in different applications.

An electrical connector having improved crosstalk compensating paddle board is desired.

SUMMARY OF THE INVENTION

A primary object of the present invention is to provide an electrical connector having a paddle board capable of reducing crosstalk between the terminals to an acceptable level.

To achieve the aforementioned object, an electrical connector includes an insulative housing, a number of contact terminals received in the insulative housing, a number of converting terminals, and a paddle board including a first through third faces, a number of conductive pads formed on the second and third faces, a number of conductive sections electrically connecting with the contact terminals, and number of conductive members electrically connecting with the number of converting terminals. A selected first conductive section of the number of conductive sections is electrically connected with a selected first conductive section of the number of conductive members via a selected first conductive pad of the number of conductive pads. A selected second conductive section of the number of conductive sections is electrically connected with a selected second conductive member of the number of conductive members via a selected second conductive pad of the number of conductive pads. A selected third conductive section of the number of conductive sections is electrically connected with a selected third conductive member of the number of conductive members via a selected third conductive pad of the number of conductive pads. The selected third conductive pad is coupled with the selected first conductive pad.

According to a test, the crosstalk between the conductive paths is reduced to an acceptable low level.

Other objects, advantages and novel features of the invention will become more apparent from the following detailed description of a preferred embodiment when taken in conjunction with the accompanying drawings.

DETAILED DESCRIPTION OF THE INVENTION

Figure 1:
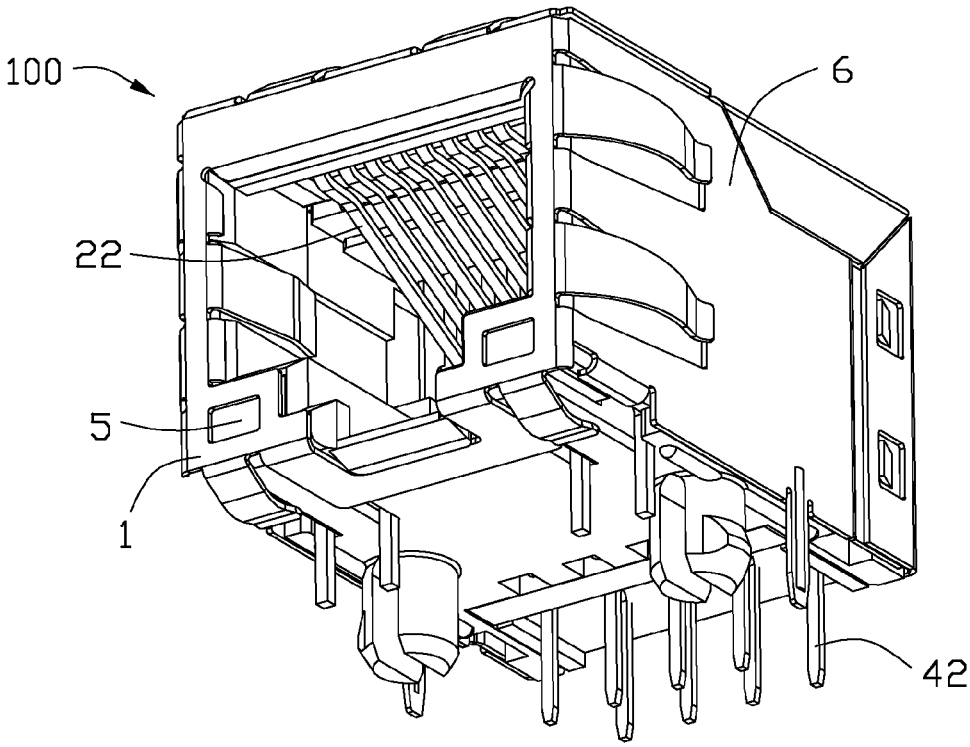
FIG. 1 is an assembled perspective view of an electrical connector in accordance with the first embodiment of the present invention.

Reference will now be made to the drawing figures to describe the present invention in detail. Referring to FIGS. 1-7, an electrical connector 100 in accordance with the first embodiment of the present invention comprises an insulative housing 1, a terminal module 20 received in the insulative housing 1, a pair of LEDs 5, and a shielding shell 6 covering the insulative housing 1.

Figure 2:
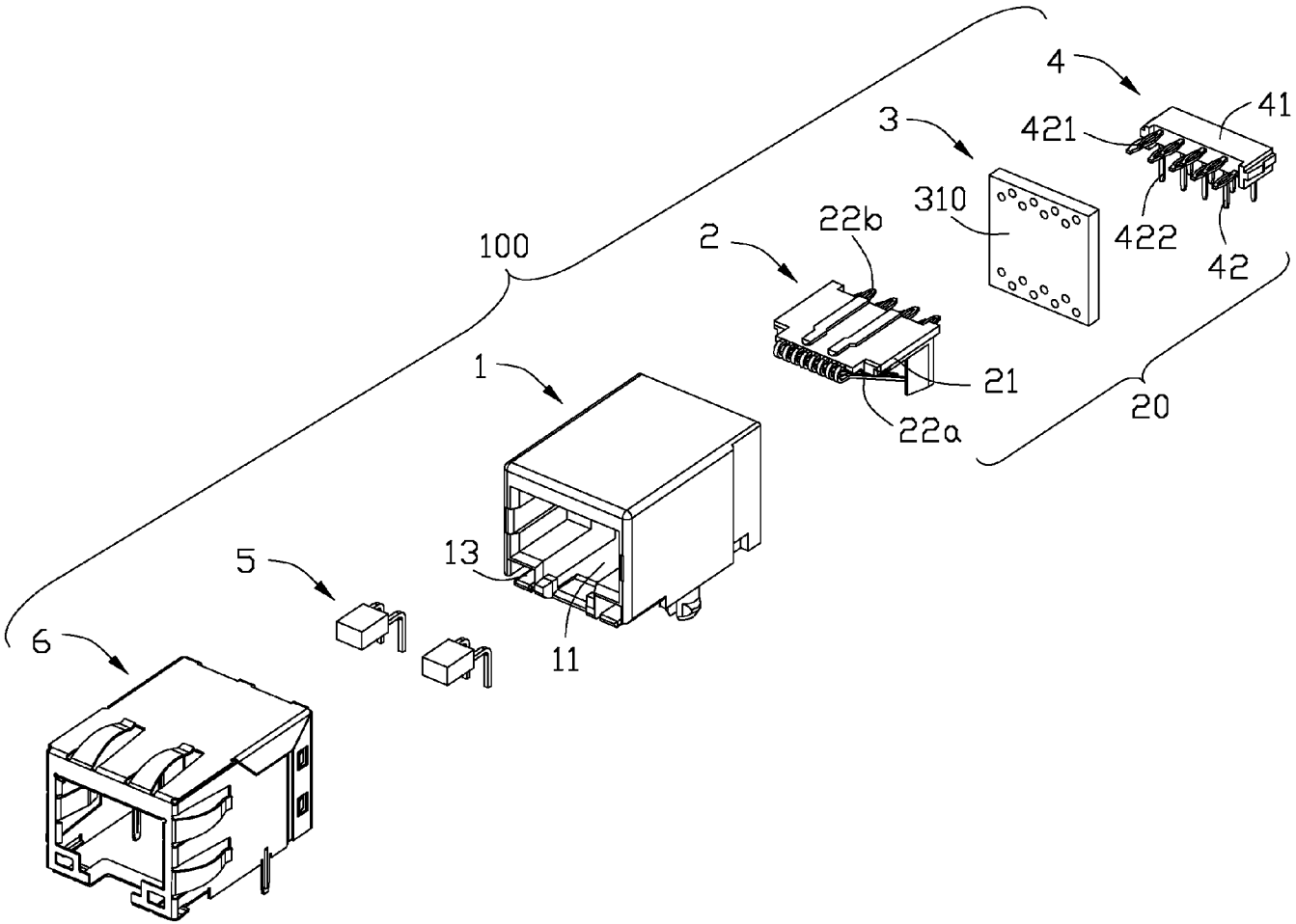
FIG. 2 is an exploded perspective view of the electrical connector as shown in FIG. 1.
Figure 3:
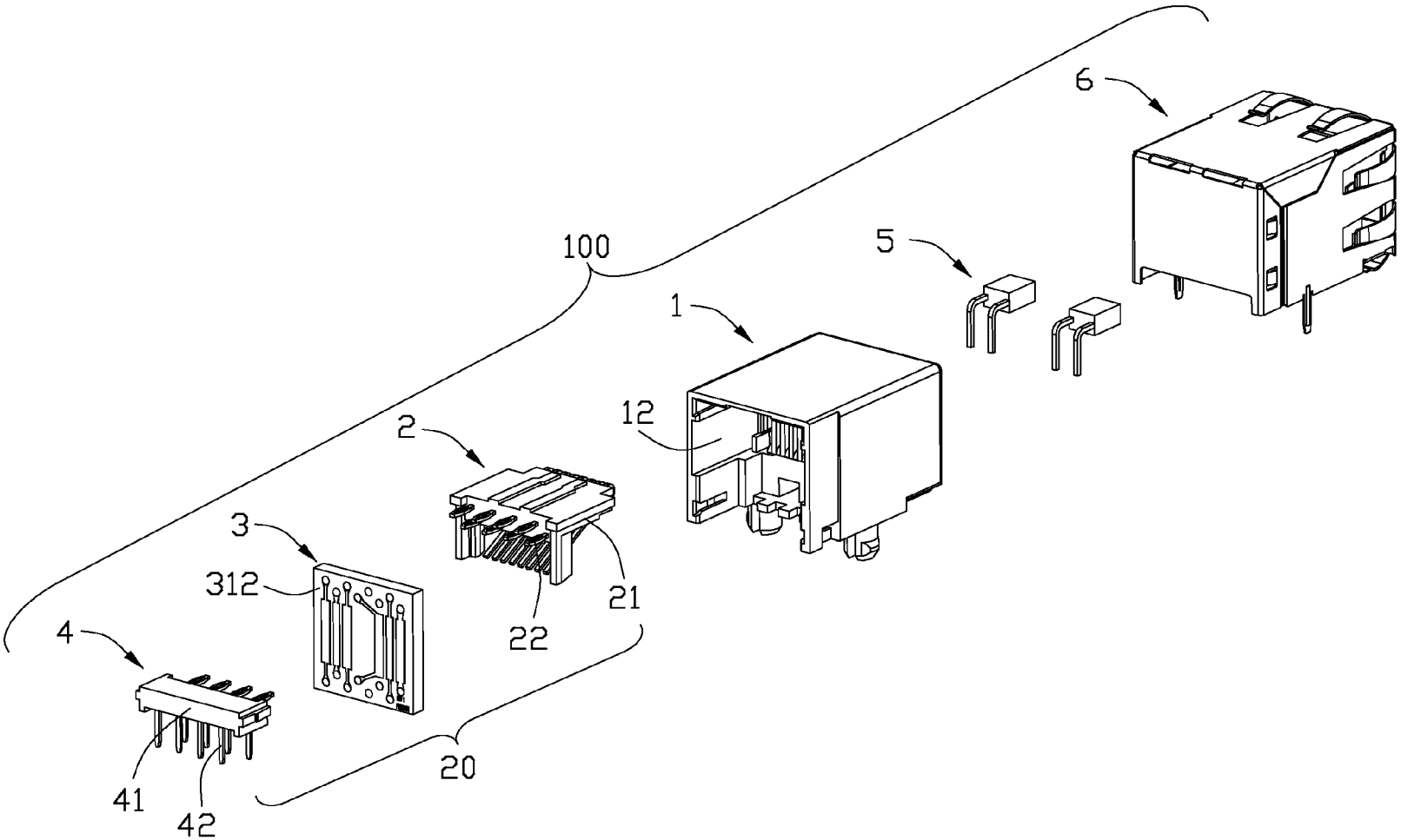
FIG. 3 is another view similar to FIG. 2, taken from another aspect.

Referring to FIGS. 2 and 3, the insulative housing 1 defines a receiving cavity 11, a receiving room 12 communicating with the receiving cavity 11, and a pair of insertion recesses 13 bilaterally located below the receiving cavity 11 for insertion of the pair of LEDs 5.

The terminal module 20 includes a paddle board 3, a terminal assembly 2 attached to the paddle board 3, and a converting module 4 assembled to the paddle board 3. Referring to FIG. 2, the terminal assembly 2 comprises a dielectric wafer 21 and a plurality of contact terminals 22 mounted in the dielectric wafer 21. The dielectric wafer 21 is configured by insert-molding the contact terminals 22, or is configured into two plates sandwiching the contact terminals 22, typically eight, altogether, i.e., first through eighth contact terminals 221-228. The first through eighth contact terminals 221-228 are arranged into two rows jog relative to each other.

The converting module 4 includes a base 41 and eight converting terminals 42 arranged in two rows jog relative to each other. Each converting terminal 42 has a conductive portion 421 and a soldering portion 422.

Figure 4:
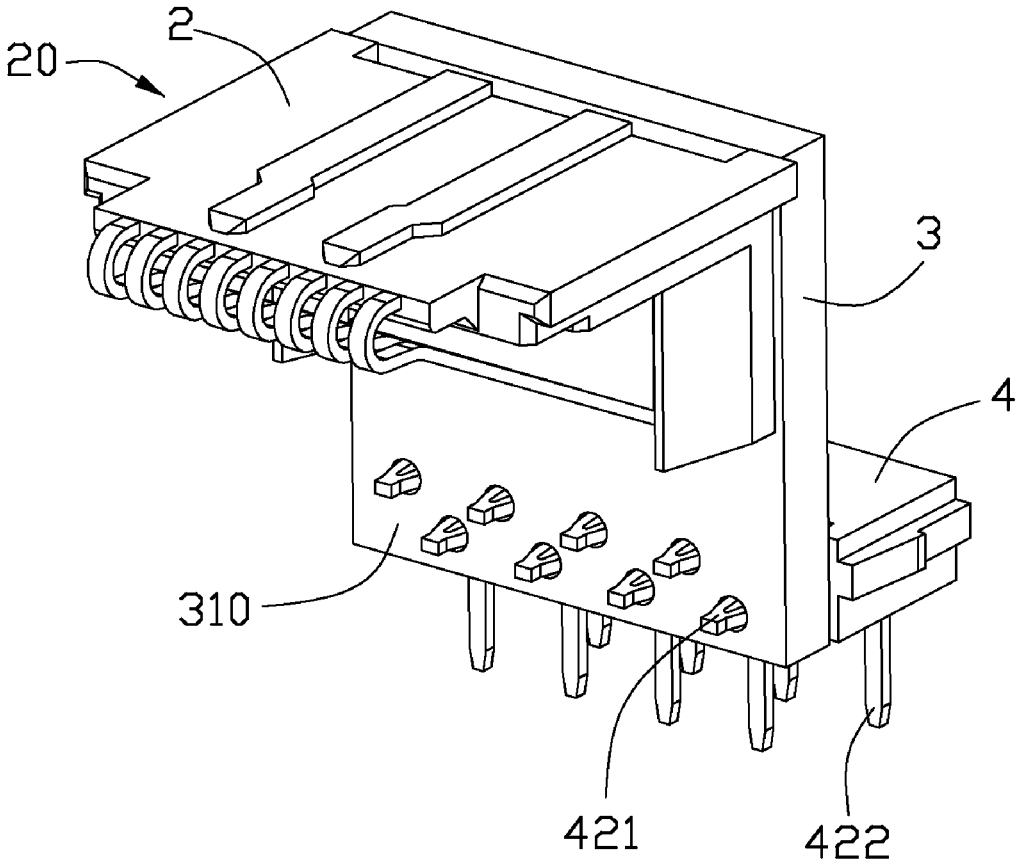
FIG. 4 is a perspective view showing the terminal module.
Figure 5:
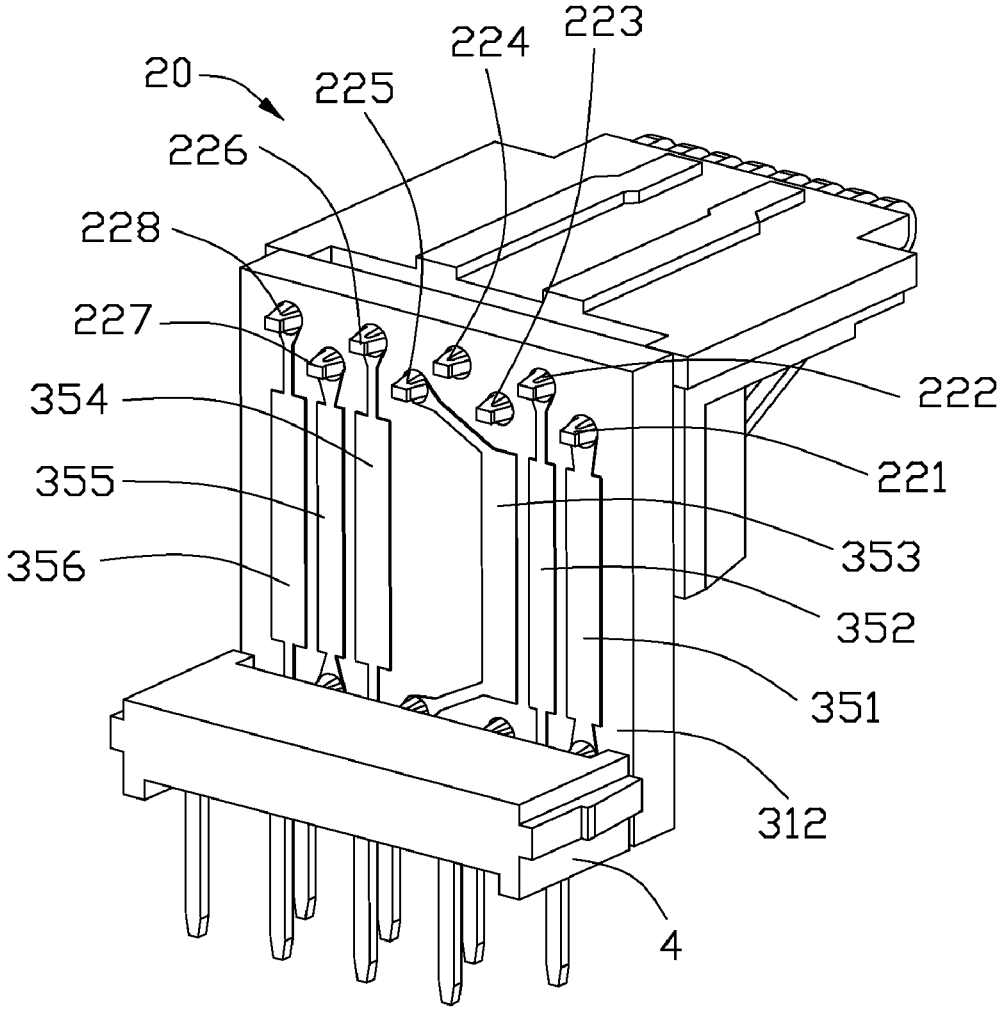
FIG. 5 is another view similar to FIG. 4, taken from another aspect.
Figure 6:
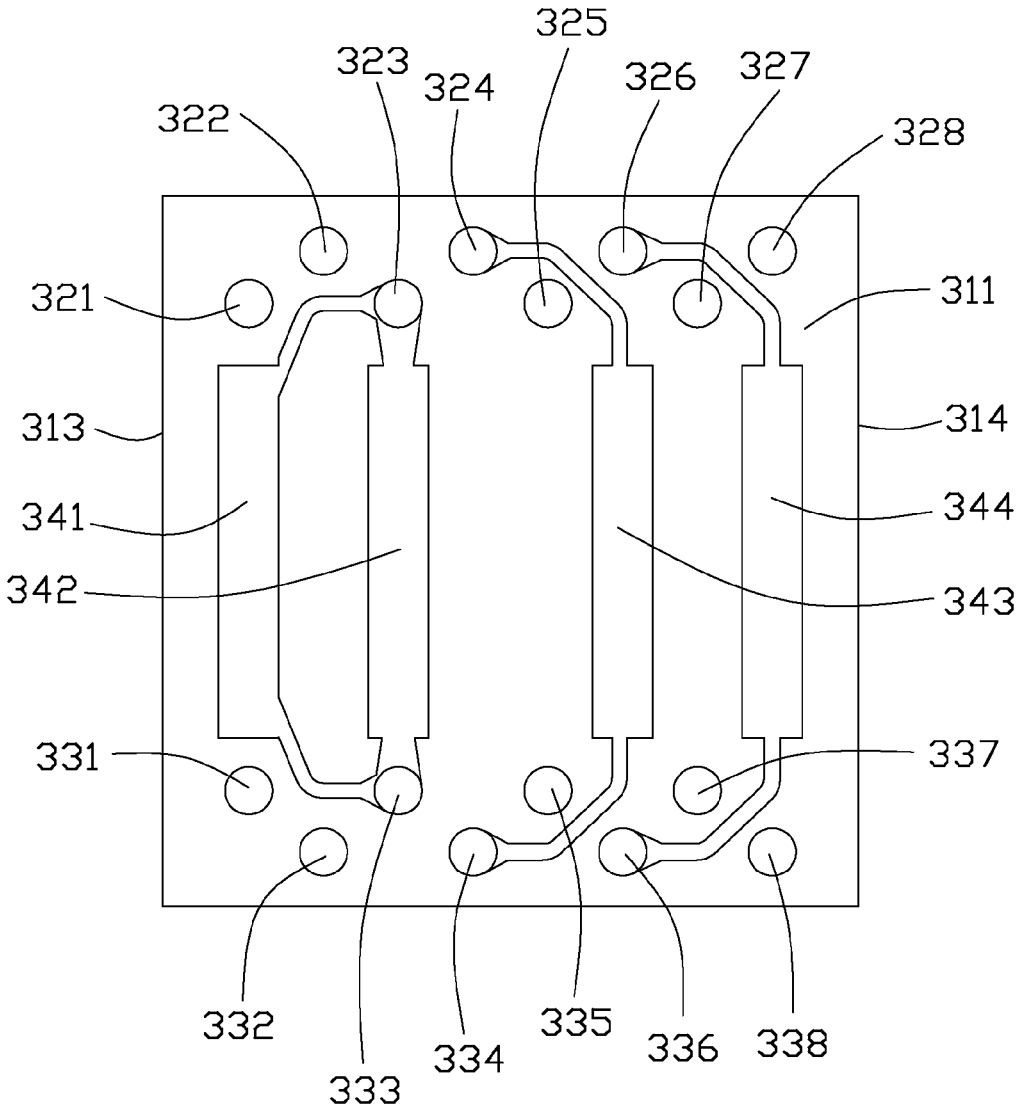
FIG. 6 is a perspective view showing an inner face of the paddle board, taken from a front-to-back aspect.
Figure 7:
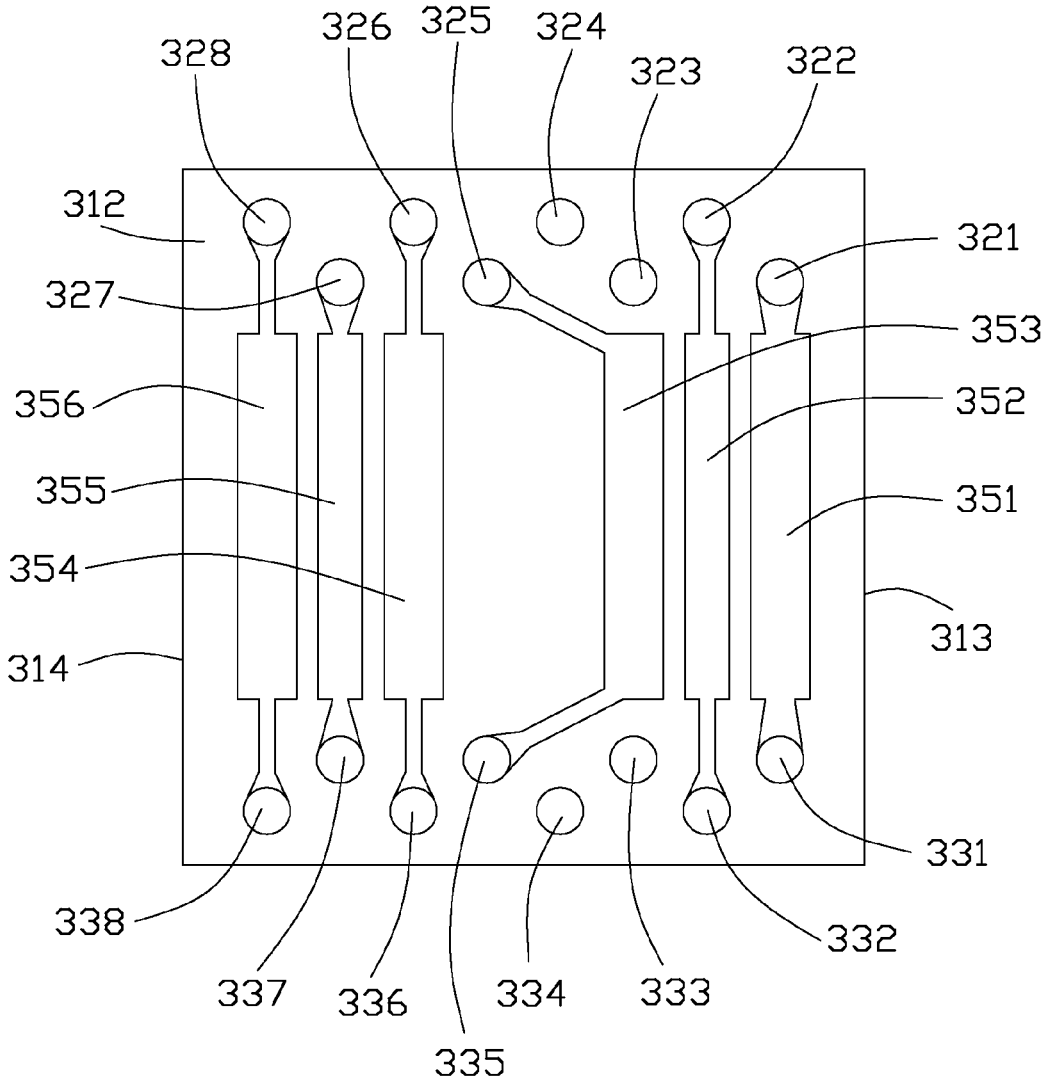
FIG. 7 is a perspective view showing a rear face of the paddle board, taken from the back-to-front aspect.
Figure 8:
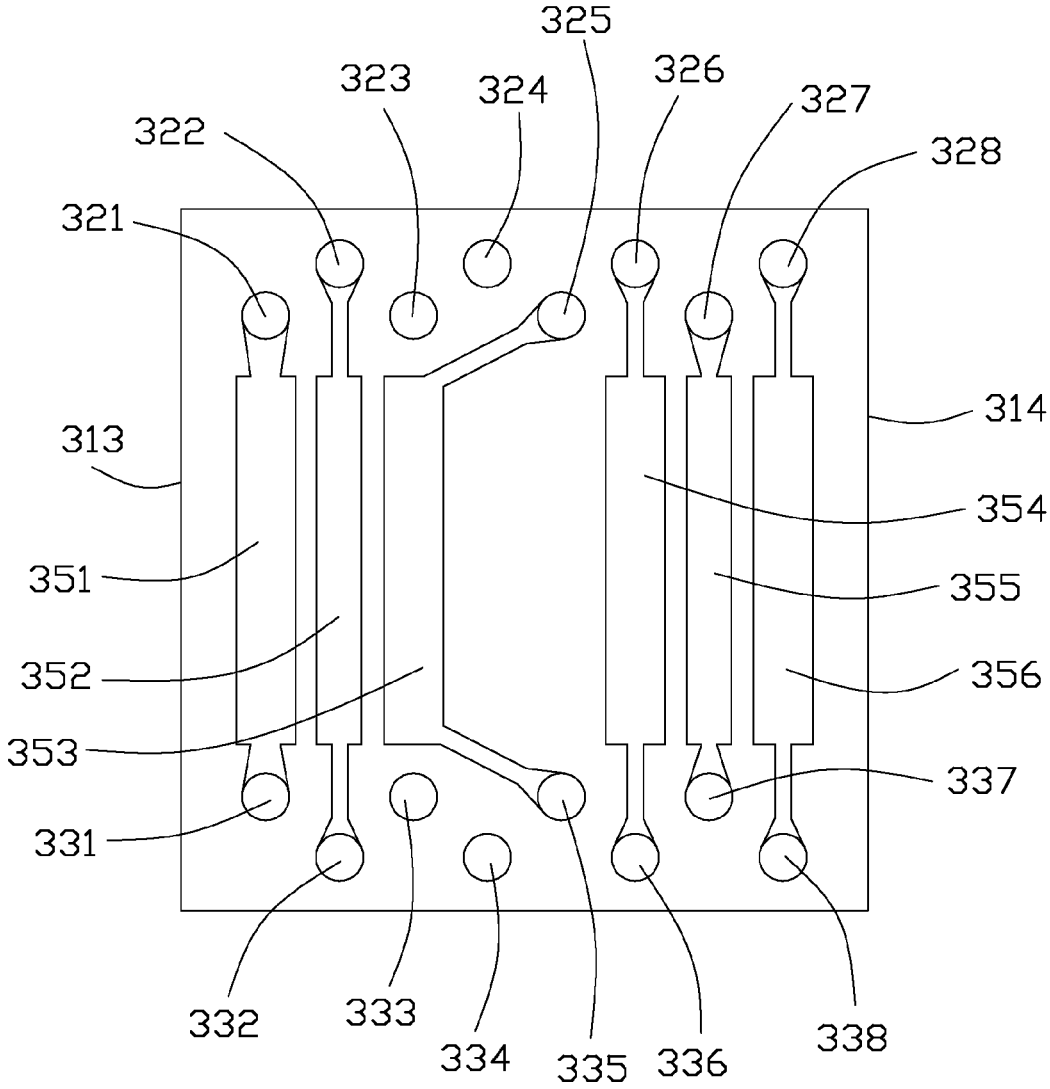
FIG. 8 is a mirror image of FIG. 7, taken from the front-to-back aspect.

FIGS. 2 and 4 show a front face or a first face 310 of the paddle board 3, taken from a front-to-back section. FIGS. 3 and 7 show a rear face or a third face 312 of the paddle board 3, taken from a back-to-front section. FIG. 6 shows an inner face or a second face 311 of the paddle board 3, taken from a front-to-back section. The three faces 310, 311, 312 are parallel, with the front face 310 facing forwardly, the rear face 312 facing rearwardly, and the inner face 311 formed within the paddle board 3. FIG. 8 is a mirror image of FIG. 7, showing the alignment between corresponding conductive pads.

The paddle board 3 includes opposite first and second sides 313 and 314. The paddle board 3 defines a first through eighth upper conductive holes 321-328 arranged into two rows jogged with each other for insertion of the first through eighth contact terminals 221-228, and a first through eighth lower conductive holes 331-338 arranged into two rows jogged with each other for insertion of the eight converting terminals 42, from the first side 313 to the second side 314 in sequence.

FIG. 6 shows the inner face 311 of the paddle board 3, taken from a front-to-back aspect. The paddle board 3 has a first through fourth front conductive pads 341-344 formed on the inner face 311 from the first side 313 to the second side 314 in sequence. The first front conductive pad 341 is located between the first upper conductive hole 321 and the first lower conductive hole 331, and is connected to the third upper conductive hole 323 and the third lower conductive hole 333.

The second front conductive pad 342 is located between the third upper conductive hole 323 and the third lower conductive hole 333, and is connected to the third upper conductive hole 323 and the third lower conductive hole 333.

The third front conductive pad 343 is located between the sixth upper conductive hole 326 and the sixth lower conductive hole 336, and is connected to the fourth upper conductive hole 324 and the fourth lower conductive hole 334.

The fourth front conductive pad 344 is located between the eighth upper conductive hole 328 and the eighth lower conductive hole 338, and is connected to the sixth upper conductive hole 326 and the sixth lower conductive hole 336.

FIG. 8 shows scenograph of the rear face 312 of the paddle board 3, taken from the front-to-back aspect. The paddle board 3 has a first through sixth rear conductive pads 351-356 formed on the rear face 312 from the first side 313 to the second side 314 in sequence. The first rear conductive pad 351 is located between the first upper conductive hole 321 and the first lower conductive hole 331, and is connected to the first upper conductive hole 321 and the first lower conductive hole 331.

The second rear conductive pad 352 is located between the second upper conductive hole 322 and the second lower conductive hole 332, and is connected to the second upper conductive hole 322 and the second lower conductive hole 332.

The third rear conductive pad 353 is located between the third upper conductive hole 323 and the third lower conductive hole 333, and is connected to the fifth upper conductive hole 325 and the fifth lower conductive hole 335.

The fourth rear conductive pad 354 is located between the sixth upper conductive hole 326 and the sixth lower conductive hole 336, and is connected to the sixth upper conductive hole 326 and the sixth lower conductive hole 336.

The fifth rear conductive pad 355 is located between the seventh upper conductive hole 327 and the seventh lower conductive hole 337, and is connected to the seventh upper conductive hole 327 and the seventh lower conductive hole 337.

The sixth rear conductive pad 356 is located between the eighth upper conductive hole 328 and the eighth lower conductive hole 338, and is connected to the eighth upper conductive hole 328 and the eighth lower conductive hole 338.

The first upper conductive hole 321 and the first lower conductive hole 331 are electrically connected by the first rear conductive pad 351 to establish a first conductive path. The second upper conductive hole 322 and the second lower conductive hole 332 are electrically connected by the second rear conductive pad 352 to establish a second conductive path. The third upper conductive hole 323 and the third lower conductive hole 331 are electrically connected by the first front conductive pad 341 and the second front conductive pad 342 to establish a pair of third conductive paths in parallel. The fourth upper conductive hole 324 and the fourth lower conductive hole 334 are electrically connected by the third front conductive pad 343 to establish a fourth conductive path. The fifth upper conductive hole 325 and the fifth lower conductive hole 335 are electrically connected by the third rear conductive pad 353 to establish a fifth conductive path. The sixth upper conductive hole 326 and the sixth lower conductive hole 336 are electrically connected by the fourth front conductive pad 344 and the fourth rear conductive pad 354 to establish a pair of sixth conductive paths in parallel. The seventh upper conductive hole 327 and the seventh lower conductive hole 337 are electrically connected by the fifth rear conductive pad 355 to establish a seventh conductive path. The eighth upper conductive hole 328 and the eighth lower conductive hole 338 are electrically connected by the sixth rear conductive pad 356 to establish an eighth conductive path.

The first and the second conductive paths are used to establish a first differential signal pair transmission route. The third and the sixth conductive paths are used to establish a second differential signal pair transmission route. The fourth and the fifth conductive paths are used to establish a third differential signal pair transmission route. The seventh and the eighth conductive paths are used to establish a fourth differential signal pair transmission route.

The first front conductive pad 341 and the first rear conductive pad 351 are aligned with each other to establish a capacitive coupling. The branch through the first front conductive pad 341 within the pair of the third conductive paths would provide a compensation to the first differential signal pair transmission route, for reducing crosstalk produced from the third conductive path to the first differential signal pair transmission route.

The second front conductive pad 342 and the third rear conductive pad 353 are aligned with each other to establish a capacitive coupling. The branch through the third rear conductive pad 353 within the fifth conductive path would provide a compensation to the third differential signal pair transmission route, for reducing crosstalk produced from the fifth conductive path to the third differential signal pair transmission route.

The third front conductive pad 343 and the fourth rear conductive pad 354 are aligned with each other to establish a capacitive coupling. The branch through the third front conductive pad 343 within the fourth conductive path would provide a compensation to the second differential signal pair transmission route, for reducing crosstalk produced from the fourth conductive path to the second differential signal pair transmission route.

The fourth front conductive pad 344 and the sixth rear conductive pad 356 are aligned with each other to establish a capacitive coupling. The branch through the fourth front conductive pad 344 within the pair of the sixth conductive paths in parallel would provide a compensation to the fourth differential signal pair transmission route, for reducing crosstalk produced from the sixth conductive path to the fourth differential signal pair transmission route.

In the first embodiment, since the first front conductive pad 341 is aligned and coupled with the first rear conductive pad 351, the second front conductive pad 342 is aligned and coupled with the third rear conductive pad 353, the third front conductive pad 343 is aligned and coupled with the fourth rear conductive pad 354, and the fourth front conductive pad 344 is aligned and coupled with the sixth rear conductive pad 356, the conductive pads 341, 351, 342, 353, 343, 354, 344, 356 are designed into a same first width. The second rear conductive pad 352 and the fifth rear conductive pad 355 are not aligned with any other conductive pads, and could be designed into a second width smaller than the first width.

According to a test, the crosstalk between the first, the second conductive paths and the third, the sixth conductive paths is reduced to −48.6 dB. The crosstalk between the first, the second conductive path and the fourth, the fifth conductive paths is reduced to −61.3 dB. The crosstalk between the third, the sixth conductive paths and the fourth, the fifth conductive paths is reduced to −42.6 dB. The crosstalk between the fourth, the fifth conductive path and the seventh, the eighth conductive path is reduced to −55.8 dB. The crosstalk between the conductive paths, therefore between the adjacent contact terminals 221-228 or the converting terminals 42, is reduced to an acceptable low level.

Figure 9:
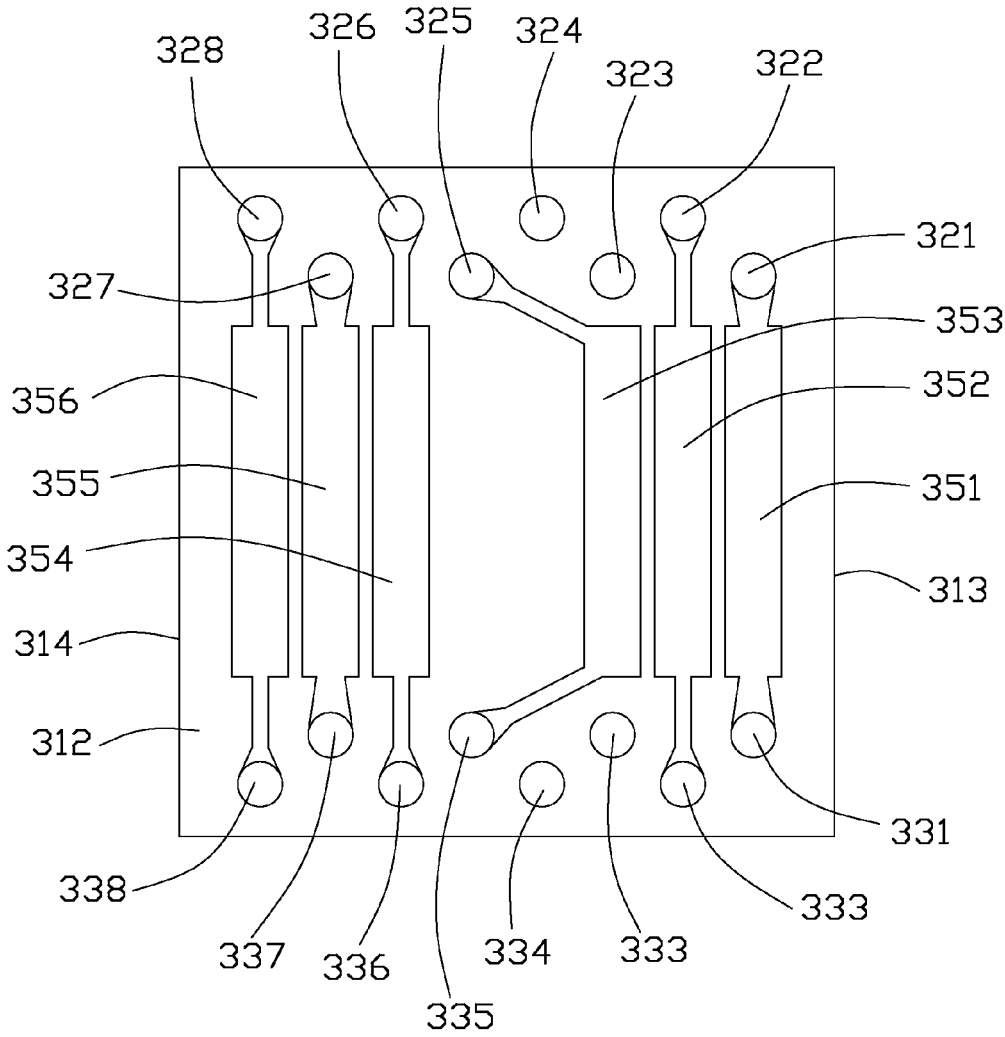
FIG. 9 is a perspective view showing a rear face of the paddle board referred in a second embodiment, taken from the back-to-front aspect.
Figure 10:
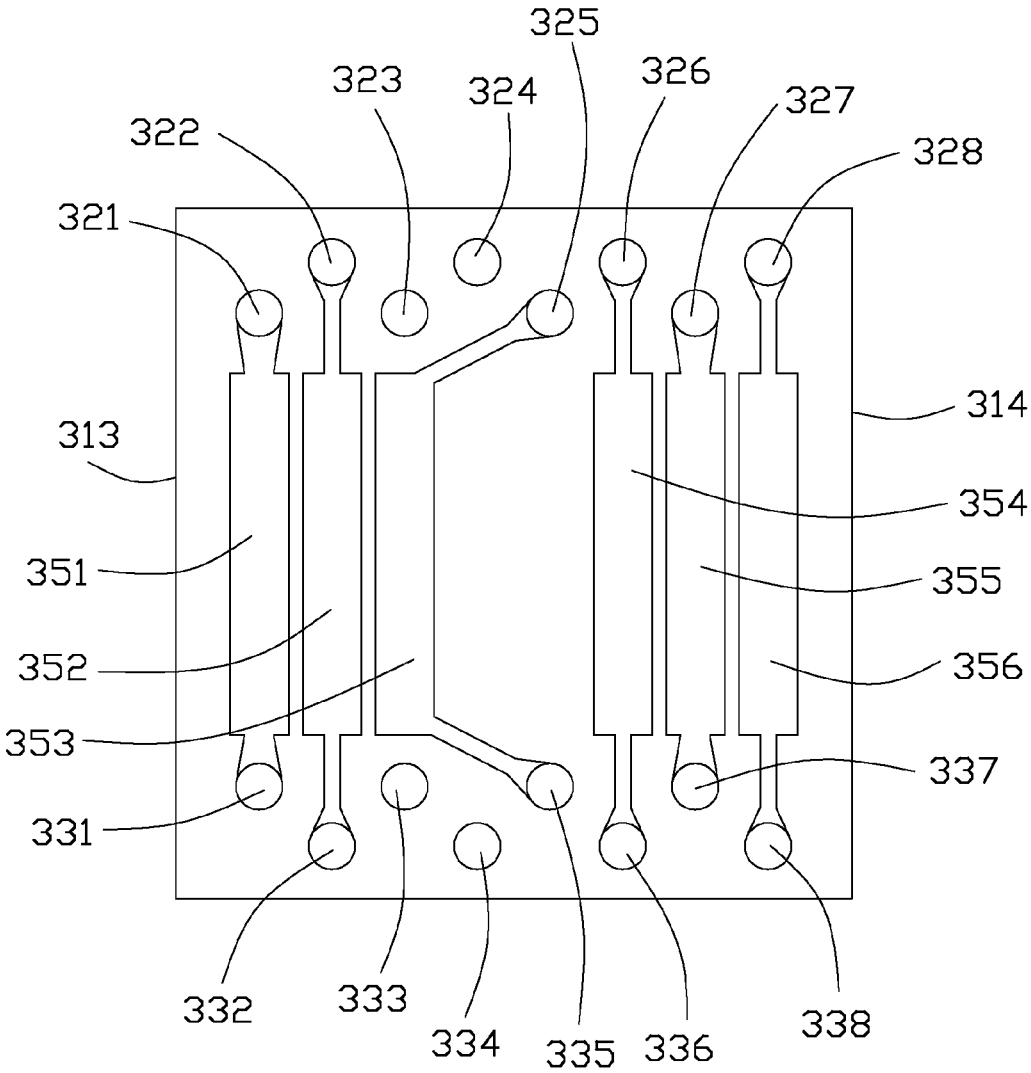
FIG. 10 is a mirror image of FIG. 9, taken from the front-to-back aspect.

FIG. 9 shows a rear face 312 of the paddle board 3 in a second embodiment. FIG. 10 is a mirror image of FIG. 9, showing the alignment between corresponding conductive pads in the second embodiment. The second and the fifth rear conductive pads 352, 355 are designed into a same first width equal to the first width of the other conductive pads 341, 351, 342, 353, 343, 354, 344, 356. According to the test, the crosstalk between the first, the second conductive paths and the third, the sixth conductive paths is reduced to −39.4 dB. The crosstalk between the first, the second conductive path and the fourth, the fifth conductive paths is reduced to −66.3 dB. The crosstalk between the first, the second conductive paths and the seventh, the eighth conductive paths is reduced to −79.5 dB. The crosstalk between the third, the sixth conductive path and the fourth, the fifth conductive path is reduced to −40.4 dB. The crosstalk between the third, the sixth conductive path and the seventh, the eighth conductive path is reduced to −38.4 dB. The crosstalk between the fourth, the fifth conductive path and the seventh, the eighth conductive path is reduced to −58.8 dB.

Optionally, the upper conductive holes 321-328 could be construed as conductive pads or other conductive sections, and interfacing portions of the contact terminals 22 are correspondingly modified. The lower conductive holes 331-338 could be similarly construed as conductive pads or other conductive members, and interfacing portions of the converting terminals 42 are also correspondingly modified.

However, the disclosure is illustrative only, changes may be made in detail, especially in matter of shape, size, and arrangement of parts within the principles of the invention.

What is claimed is:

1. An electrical connector comprising:

an insulative housing;

a plurality of contact terminals received in the insulative housing;

a plurality of converting terminals; and a paddle board comprising a first through third faces, a plurality of conductive pads formed in the second and third faces, a plurality of conductive sections electrically connecting with the contact terminals, and a plurality of conductive members electrically connecting with the converting terminals, a selected first conductive section of the plurality of conductive sections being electrically connected with a selected first conductive member of the plurality of conductive members via a selected first conductive pad of the plurality of conductive pads, a selected second conductive section of the plurality of conductive sections being electrically connected with a selected second conductive member of the plurality of conductive members via a selected second conductive pad of the plurality of conductive pads, a selected third conductive section of the plurality of conductive sections being electrically connected with a selected third conductive member of the plurality of conductive members via a selected third conductive pad of the plurality of conductive pads, said selected third conductive pad being coupled with the selected first conductive pad.

2. The electrical connector as claimed in claim 1, wherein:

said plurality of conductive sections comprise a first through eighth upper conductive holes extending through the first through third faces for insertion of the contact terminals;

said plurality of conductive members comprise a first through eighth lower conductive holes extending through the first through third faces for insertion of the converting terminals;

said plurality of conductive pads comprise a first through fourth front conductive pads formed on the second face, and a first through sixth rear conductive pads formed on the third face of the paddle board; and said second face is formed within the paddle board between the first face and the third face.

3. The electrical connector as claimed in claim 2, wherein said selected third conductive section is electrically connected with said selected third conductive member via said selected third conducive pad and a selected fourth conductive pad of said plurality of conducive pads in parallel, said selected fourth conductive pad being located between the selected third conductive section and the selected third conductive member.

4. The electrical connector as claimed in claim 3, wherein:

said selected first conductive section constitutes the first upper conductive hole, the selected first conductive member constitutes the first lower conductive hole, and said selected first conductive pad constitutes the first rear conductive pad located between the first upper and lower conductive holes;

said selected second conductive section constitutes the second upper conductive hole, said selected second conductive member constitutes the second lower conductive hole, and said selected second conductive pad constitutes the second rear conductive pad located between the second upper and lower conductive holes; and said selected third conductive section constitutes the third upper conductive hole, the selected third conductive member constitutes the third lower conductive hole, and said selected third conductive pad constitutes the first front conductive pad located between the first upper and lower conductive holes.

5. The electrical connector as claimed in claim 4, wherein said selected fourth conductive pad constitutes the second front conductive pad located between and electrically connected with the third conductive section and the third conductive member.

6. The electrical connector as claimed in claim 3, wherein:

said selected first conductive section constitutes the eighth upper conductive hole, the selected first conductive member constitutes the eighth lower conductive hole, and said selected first conductive pad constitutes the sixth rear conductive pad located between the eighth upper and lower conductive holes;

said selected second conductive section constitutes the seventh upper conductive hole, and the selected second conductive member constitutes the seventh lower conductive hole, and said selected second conductive pad constitutes the fifth rear conductive pad located between the seventh upper and lower conductive holes; and said selected third conductive section constitutes the sixth upper conductive hole, and the selected third conductive member constitutes the sixth lower conductive hole, and said selected third conductive pad constitutes the fourth front conductive pad located between the eighth upper and lower conductive holes.

7. The electrical connector as claimed in claim 6, wherein said selected fourth conductive pad constitutes the fourth rear conductive pad located between and electrically connected with the sixth conductive section and the sixth conductive member.

8. The electrical connector as claimed in claim 2, wherein:

said selected first conductive section constitutes the third upper conductive hole, the selected first conductive member constitutes the third lower conductive hole, and said selected first conductive pad constitutes the second front conductive pad located between the third upper and lower conductive holes;

said selected second conductive section constitutes the sixth upper conductive hole, said selected second conductive member constitutes the sixth lower conductive hole, and said selected second conductive pad constitutes the fourth rear conductive pad located between the sixth upper and lower conductive holes; and said selected third conductive section constitutes the fifth upper conductive hole, said selected third conductive member constitutes the fifth lower conductive hole, and said selected third conductive pad constitutes the third rear conductive pad located between the third upper and lower conductive holes.

9. The electrical connector as claimed in claim 2, wherein:

said selected first conductive section constitutes the sixth upper conductive hole, said selected first conductive member constitutes the sixth lower conductive hole, and said selected first conductive pad constitutes the fourth rear conductive pad located between the sixth upper and lower conductive holes;

said selected second conductive section constitutes the third upper conductive hole, said selected second conductive member constitutes the third lower conductive hole, and said selected second conductive pad constitutes the second front conductive pad located between the third upper and lower conductive holes; and said selected third conductive section constitutes the fourth upper conductive hole, said selected third conductive member constitutes the fourth lower conductive hole, and said selected third conductive pad constitutes the third front conductive pad located between the sixth upper and lower conductive holes.

10. The electrical connector as claimed in claim 2, wherein said plurality of conductive pads have a same width.

11. The electrical connector as claimed in claim 2, wherein said second rear conductive pad and the fifth rear conductive pad are designed into a second width smaller than a first width of the other conductive pads of the plurality of conductive pads.

12. A paddle board of an electrical connector comprising:

a first through third faces;

a plurality of conductive pads formed in the second and third faces;

a plurality of conductive sections for electrically connecting with a plurality of contact terminals; and and a plurality of conductive members for electrically connecting with a plurality of converting terminals, a selected first conductive section of the plurality of conductive sections being electrically connected with a selected first conductive member of the plurality of conductive members via a selected first conductive pad of the plurality of conductive pads, a selected second conductive section of the plurality of conductive sections being electrically connected with a selected second conductive member of the plurality of conductive members via a selected second conductive pad of the plurality of conductive pads, a selected third conductive section of the plurality of conductive sections being electrically connected with a selected third conductive member of the plurality of conductive members via a selected third conductive pad of the plurality of conductive pads, said selected third conductive pad being coupled with said selected first conductive pad.

13. The paddle board of an electrical connector as claimed in claim 12, wherein said selected third conductive section is electrically connected with said selected third conductive member via said selected third conducive pad and a selected fourth conductive pad of said plurality of conducive pads in parallel, said selected fourth conductive pad being located between the selected third conductive section and the selected third conductive member.

14. The paddle board of an electrical connector as claimed in claim 13, wherein:

said plurality of conductive sections comprise a first through eighth upper conductive holes for insertion of eight contact terminals;

said plurality of conductive members comprise a first through eighth lower conductive holes for insertion of eight converting terminals; and said plurality of conductive pads comprise a first through fourth front conductive pads formed on the second face, and a first through sixth rear conductive pads formed on the third face of the paddle board.

15. The paddle board of an electrical connector as claimed in claim 14, wherein said first through third faces are parallel, with the first face facing forwardly, the second face facing rearwardly, the second face formed within the paddle board.

16. An electrical connector comprising:

a paddle board defining first and second faces in two different planes spaced from each other in a thickness direction;

a plurality of upper contacts dispersed in a transverse direction, which is perpendicular to the thickness direction, and having corresponding tails extending through an upper region of the paddle board;

a plurality of lower contacts dispersed in the transverse direction and spaced from the upper contacts in a height direction perpendicular to both said thickness direction and said transverse direction, said contacts having a same amount with the upper contacts in a one to one electrical connection manner, and having corresponding tails extending through a lower region of the paddle board;

a plurality of connection pads formed on the first face each to electrically connect the corresponding pair of upper contact and lower contacts mostly in a straight manner;

a plurality of coupling pads formed on the second face each to electrical connect the corresponding pair of upper and lower contacts while being in an extending offset manner for coupling to a corresponding connection pad of another pair of upper contact and lower contact on the first face, which is not a first neighbor with the corresponding connection pad of the pair of upper and lower contacts but a second neighbor; wherein one pair of upper and lower contacts has both the corresponding connection pad and the corresponding coupling pad on the same one of the first and second faces.

17. The electrical connector as claimed in claim 16, wherein said same one of the first and second faces is the second face.

18. The electrical connector as claimed in claim 16, wherein a specific one pair of upper and lower contacts has the corresponding connection pad on the first face in the extending offset manner to also function as the coupling pad.

19. The electrical connector as claimed in claim 18, wherein said specific one pair of upper and lower contacts couples to the pair of upper and lower contacts having both the corresponding connection pad and coupling pad on the same face.

* * * * *